US008616798B2

(12) United States Patent
Lockhart et al.

(10) Patent No.: US 8,616,798 B2
(45) Date of Patent: Dec. 31, 2013

(54) REPORT COVER

(75) Inventors: Gregory L. Lockhart, Garland, TX (US); Eric S. Israel, Garland, TX (US)

(73) Assignee: Lockhart Industries, Inc., Dallas, TX (US)

( * ) Notice: Subject to any disclaimer, the term of this patent is extended or adjusted under 35 U.S.C. 154(b) by 144 days.

(21) Appl. No.: 12/583,186

(22) Filed: Aug. 14, 2009

(65) Prior Publication Data

US 2011/0038662 A1 Feb. 17, 2011

(51) Int. Cl.

| | |
|---|---|
| ***B42D 1/00*** | (2006.01) |
| ***B42D 5/00*** | (2006.01) |
| ***B42D 3/00*** | (2006.01) |
| ***B42D 7/00*** | (2006.01) |
| ***B42D 17/00*** | (2006.01) |
| ***B42D 15/00*** | (2006.01) |
| ***B42F 3/00*** | (2006.01) |
| ***B42F 13/02*** | (2006.01) |
| ***B42F 13/06*** | (2006.01) |
| ***B42F 13/08*** | (2006.01) |
| ***B42F 13/00*** | (2006.01) |

(52) U.S. Cl.

USPC ..... 402/18; 281/3.1; 281/15.1; 281/29; 281/45; 281/49; 283/63.1; 283/64; 402/8; 402/14; 402/73; 402/74; 402/75; 402/76; 402/77

(58) Field of Classification Search

USPC ..... 281/3.1, 4, 15.1, 21, 29, 31, 45, 49, 51; 283/63.1, 64, 117; 402/8, 14, 18, 73, 402/74, 75, 76, 77, 80 R

See application file for complete search history.

(56) References Cited

U.S. PATENT DOCUMENTS

| | | | | |
|---|---|---|---|---|
| 421,028 | A | 2/1890 | Jones | |
| 471,660 | A | 3/1892 | Walkup | |
| 687,437 | A | 11/1901 | Reynolds et al. | |
| 894,478 | A | 7/1908 | Blaine, Jr. | |
| 1,577,558 | A * | 3/1926 | Brown et al. | 402/75 |
| 1,665,128 | A | 4/1928 | Cather | |
| 2,005,717 | A | 6/1935 | Coulston | |
| 2,153,399 | A | 4/1939 | Steinthal | |
| 2,233,228 | A | 2/1941 | Swift | |
| 4,950,097 | A * | 8/1990 | Blumberg | 402/8 |
| 4,993,861 | A | 2/1991 | Blumberg et al. | |
| 5,895,165 | A * | 4/1999 | Mogelonsky | 281/31 |
| 2005/0100394 | A1* | 5/2005 | Arkwright | 402/8 |
| 2007/0029779 | A1* | 2/2007 | Silvers et al. | 281/29 |
| 2009/0022543 | A1* | 1/2009 | Pyle | 402/75 |

OTHER PUBLICATIONS

STERATAPE LTD Product Data Sheet for Product 2491F pressure sensitive tape.

* cited by examiner

*Primary Examiner* — Dana Ross
*Assistant Examiner* — Justin V Lewis
(74) *Attorney, Agent, or Firm* — Law Office of William Gustavson, PC

(57) ABSTRACT

A cover (10) is disclosed for holding objects such as papers and reports. The cover (10) is formed of a member (20) having a front cover (22), a spine (24) and a back cover (26). A first portion (32) and a second portion (38) are folded over to encapsulate a prong fastener (12). The second portion (38) is then fastened to the back cover (26) with adhesive tape (58). The first and second portions (32, 38) can be part of a fastener assembly (70) having a third portion (72) that is secured to the inner surface (62) of the back cover (26). In a modification, a flap (128) can be hinged to the side of the back cover (126).

20 Claims, 21 Drawing Sheets

REPORT COVER

BACKGROUND OF THE INVENTION

It is often desirable to place papers and documents in a cover for storage and protection. A common method is to put two punched holes in a top edge of the papers and fit them over a prong fastener of the type sold by Acco and Speedway in a cover.

In the past, it has often been the case that many different types of covers have needed to be stocked to accommodate different sizes and types of reports. Further, it has been the case that extensive assembly of the cover is necessary at the time the papers are inserted in the cover. This can be very difficult when preparing many covers in a short time, such as during tax season.

It is desirable to provide identification on the cover's spine or front to note the contents within the cover, assuming that it will be placed on a shelf or in a file drawer with other covers, in order to distinguish one cover from another. Also, it is desirable to put a firm or company name or logo on the cover to provide a professional appearance.

A need exists to provide an elegant, high image professional looking cover which is also economical and easy to assemble. It is also desirable to make it as easy as possible to insert and remove papers from the cover. This makes it easier to remove or add documents in revisions, or to take out documents for copying. Also, it is desirable to have the cover allow the contents to lie flat on a table. Further, as such covers are often used on surfaces that can be scratched, it is best to avoid use of exposed metal, or other hard objects, such as rivets or the like that could scratch or mar a surface.

SUMMARY OF THE INVENTION

In accordance with one aspect of the present invention, a cover is provided comprising a member forming a front cover, spine and back cover. A first portion is hinged to a top edge of the back cover at a first hinge and a second portion is hinged to a top edge of the first portion at a second hinge. The first portion has at least two slits formed therein at a set distance apart. Each prong of a prong fastener is inserted through one of the slits. The second portion is folded over the first portion so that a first side of the second portion contacts a first side of the first portion with the second portion covering the base of the prong fastener. The first portion is folded over the back cover at the first hinge so that a second side of the second portion contacts an inner surface of the back cover. An adhesive tape between the second side of the second portion and the inner surface of the back cover secures the first and second portions to the back cover.

In accordance with another aspect of the present invention, the first and second portions are part of a fastener assembly including a third portion hinged to the bottom of the first portion along a third hinge. An adhesive tape between the third portion and the back cover secures the fastener assembly to the back cover so that the third hinge forms the first hinge. The cover can have an add on or built in pocket, and a business card or CD slot. The spine can have multiple scorelines. In accordance with another aspect of the present invention, a cover is provided comprising a member forming a front cover, spine, back cover and a flap hinged to a edge of the back cover at a first hinge.

BRIEF DESCRIPTION OF THE DRAWINGS

A more complete understanding of the invention and its advantages will be apparent from the following Detailed Description when taken in conjunction with the accompanying Drawings, in which.

DETAILED DESCRIPTION

Figure 5:
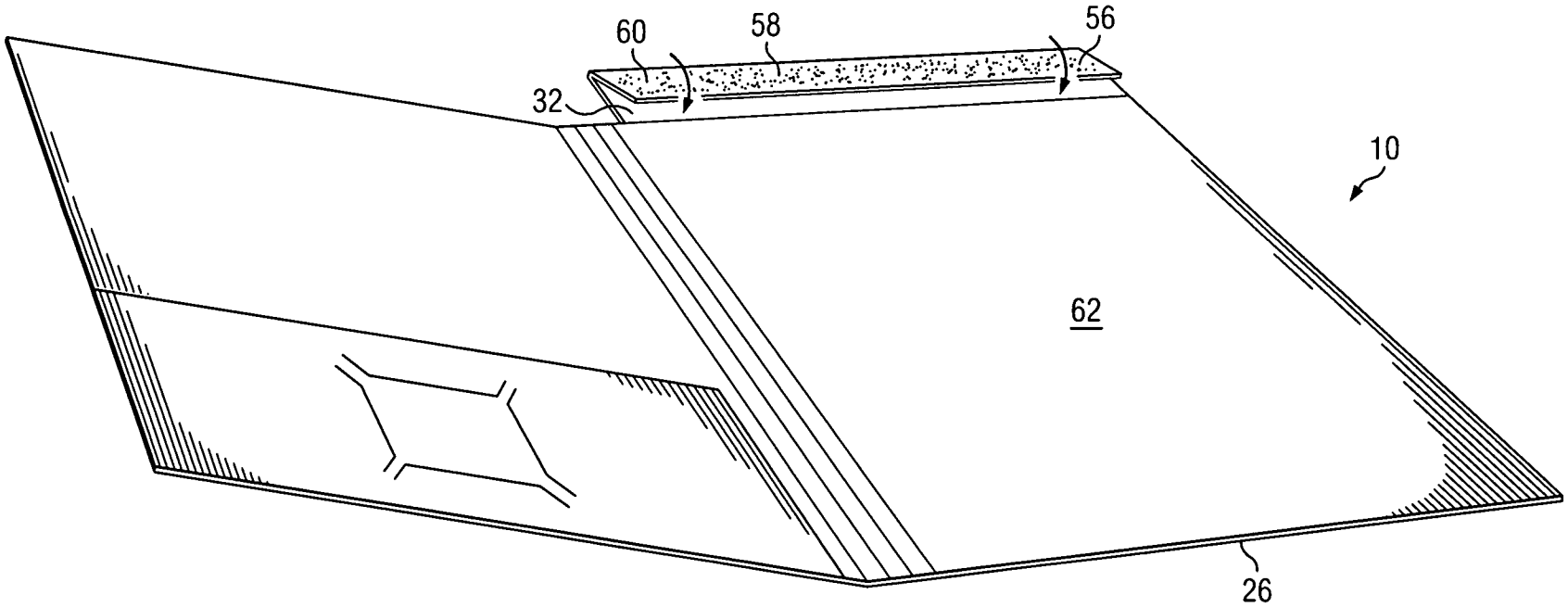
FIG. 5 is a view of the cover of FIG. 1 with the adhesive tape exposed.
Figure 6:
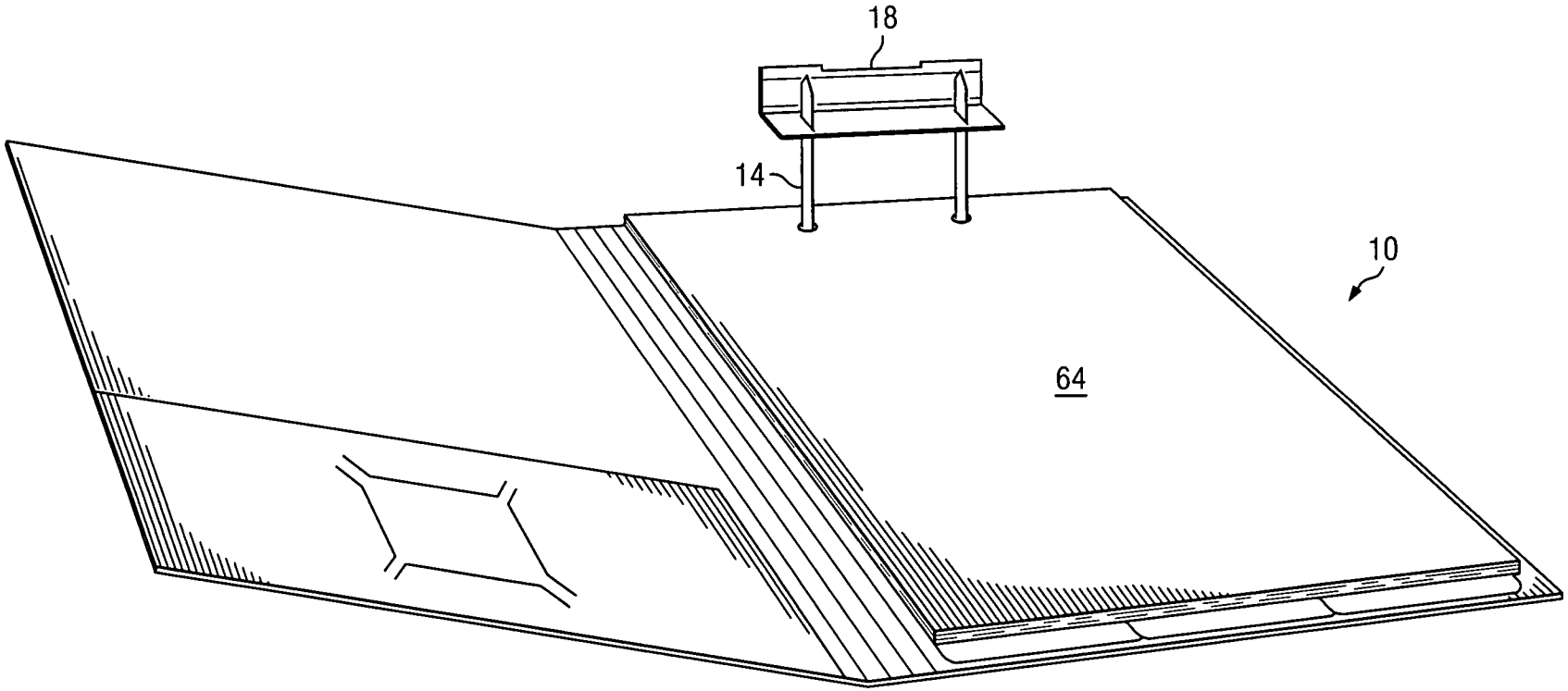
FIG. 6 is a view of the cover of FIG. 1 with documents inserted in the cover and ready to receive the clip.

With reference now the Figures, wherein like reference characters designate like or corresponding parts throughout the several views, and in particular to FIGS. 1-13, a report cover 10 forming a first embodiment of the present invention is disclosed. The cover 10 is designed to contain objects such as papers, documents, reports, and other items secured in the cover 10, preferably using holes at a top edge of the objects as is commonly done when using a prong fastener 12. As seen in FIG. 3, a typical prong fastener 12 includes deformable prongs 14 extending from a base 16. Some prong fasteners 14 also use a clip 18 as shown in FIG. 6 to hold the prongs 14 in the well known manner. Such prong fasteners are made by Speedway Company at 221 West Alameda Ave., Suite 203, Burbank Calif., 91502, having a web site at www.filefasteners.com and sold in catalogs such as the Office Depot catalog, for example. Such fasteners are also commonly referred to as an Acco fastener, after another company that made them.

Figure 1:
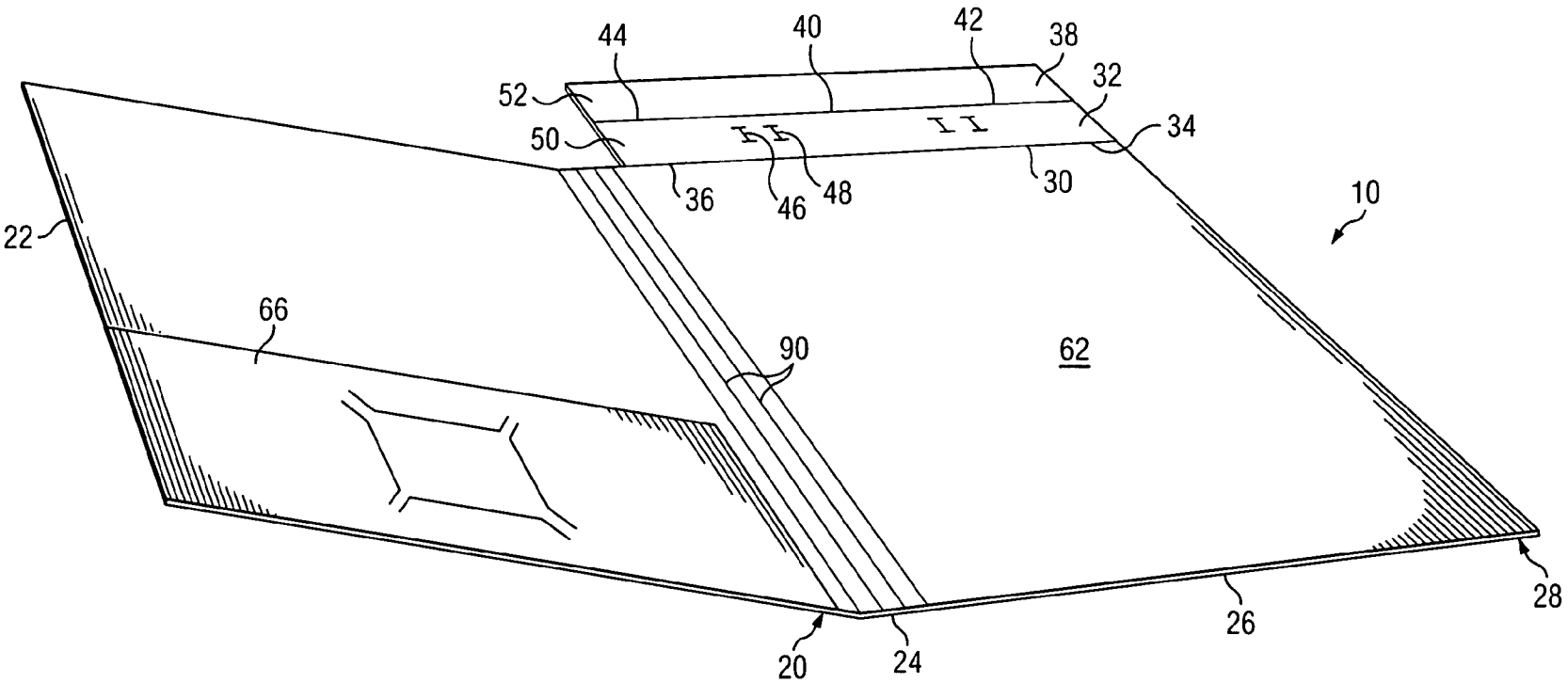
FIG. 1 is a perspective view of a cover forming a first embodiment of the present invention.

With reference now to FIG. 1, the cover 10 can be seen to include a member 20 forming the front cover 22, spine 24 and back cover 26 of the cover 10. The member 20 is preferably formed by a single integral sheet of material 28, such as 130 lb, 160 lb, 210 lb, 240 lb or 260 lb paper. From the upper edge 30 of back cover 26 extends a first portion 32. The back cover 26 and first portion 32 are connected by a score line 34 that forms a first hinge 36 between the back cover 26 and first portion 32. A second portion 38 extends from the upper edge 40 of the first portion 32. The first portion 32 and second portion 38 are connected by a score line 42 that forms a second hinge 44. Second hinge 44 is parallel first hinge 36.

As seen in FIG. 1, the first portion 32 has two sets of slits 46 and 48 formed there through. Each set of slits 46 and 48 are set apart a predetermined distance matching the separation of the prongs 14 in the prong fastener 12. Use of two sets of slits allows the cover 10 to be used with two different sizes of prong fastener, for example fasteners with 2¾ inches between prongs or fasteners with 4¼ inches between prongs. However, if only one size prong fastener is to be used, only one set of slits needs be die cut in first portion 32.

Figure 2:
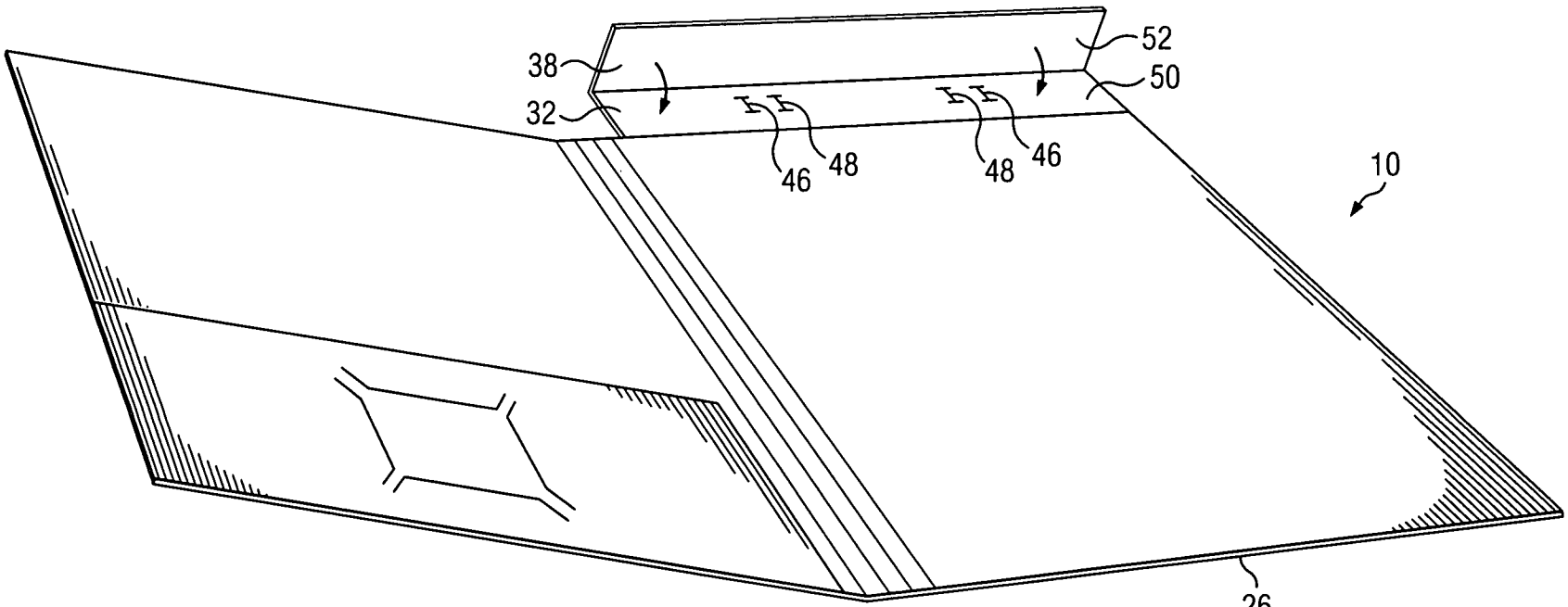
FIG. 2 is a view of the cover of FIG. 1 with the portions being folded.
Figure 3:
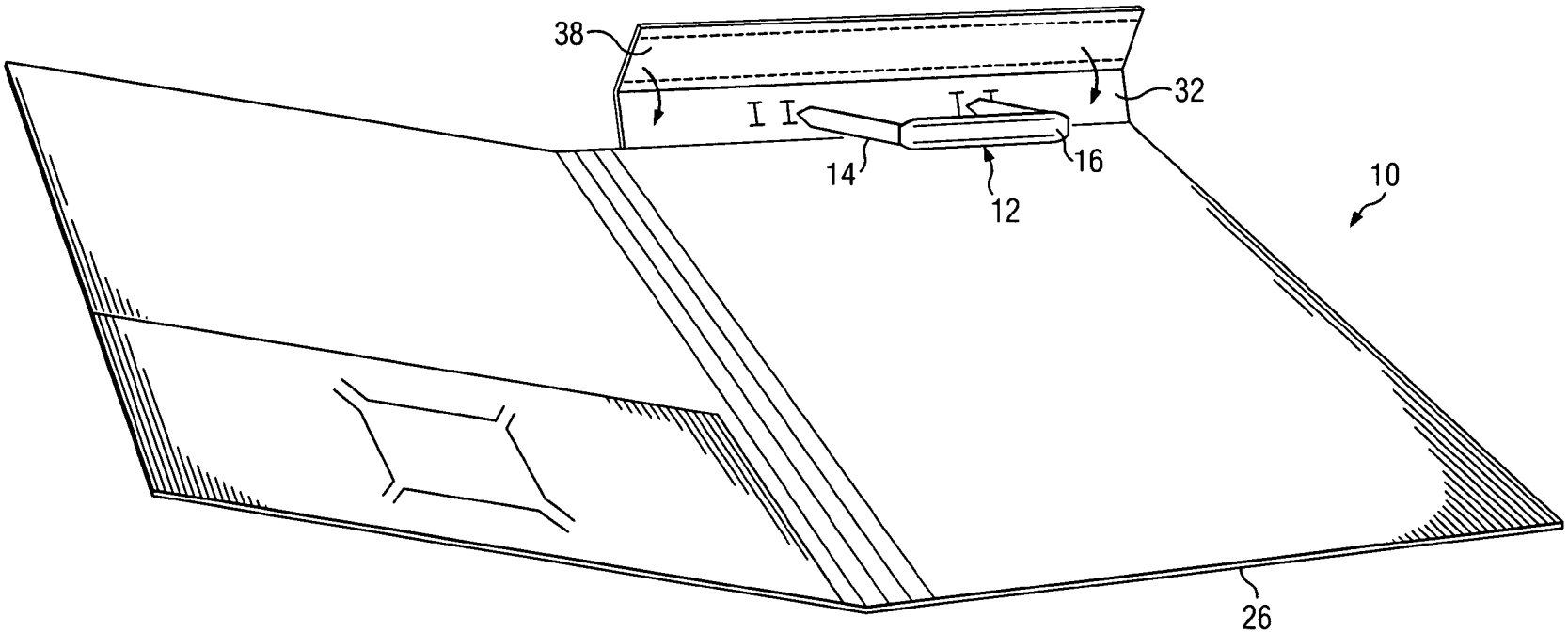
FIG. 3 is a view of the cover of FIG. 1 with the prong fastener about to be inserted.
Figure 4A:
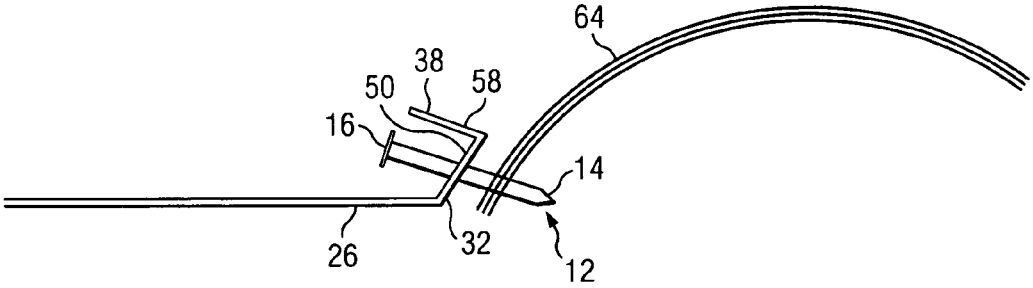
FIGS. 4A and 4B are cross sectional views of the cover of FIG. 1 with the prong fastener inserted.

In use, the second portion 38 begins to be folded over the first portion 32 at the second hinge 44 as seen in FIG. 2 so that the first side 52 of second portion 38 begins to move into contact with the first side 50 of the first portion 32. At this point, the prongs 14 can be inserted through the slits 46 or 48 from the first side 50 as seen in FIG. 3. FIG. 4A shows the prongs 14 being inserted through the slits with the base 16 moving into contact with the first side 50 of first portion 32. The second portion 38 continues to be folded about second hinge 44 until the first side 52 of second portion 38 contacts the first side 50 of first portion 32 as seen in FIG. 5. This encapsulates the base 16 between the first and second portions 32 and 38 and holds the prong fastener in place. As seen in FIG. 5, the second side 56 of second portion 38 has an adhesive tape 58 thereon, preferably covered by a protective sheet 60 until ready for use.

Figure 4B:
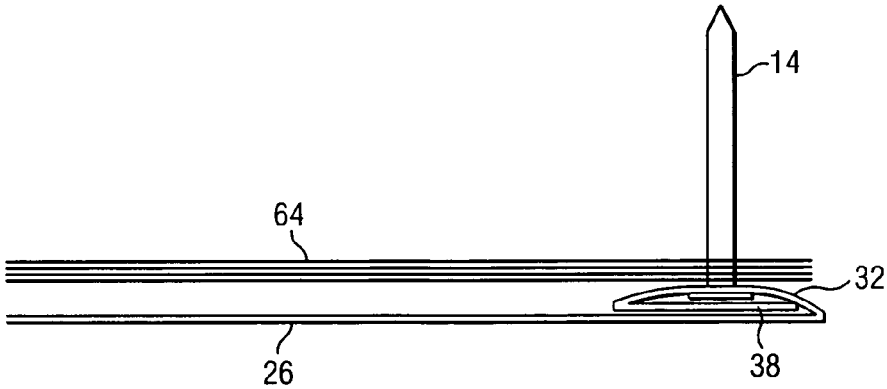
Figure 7:
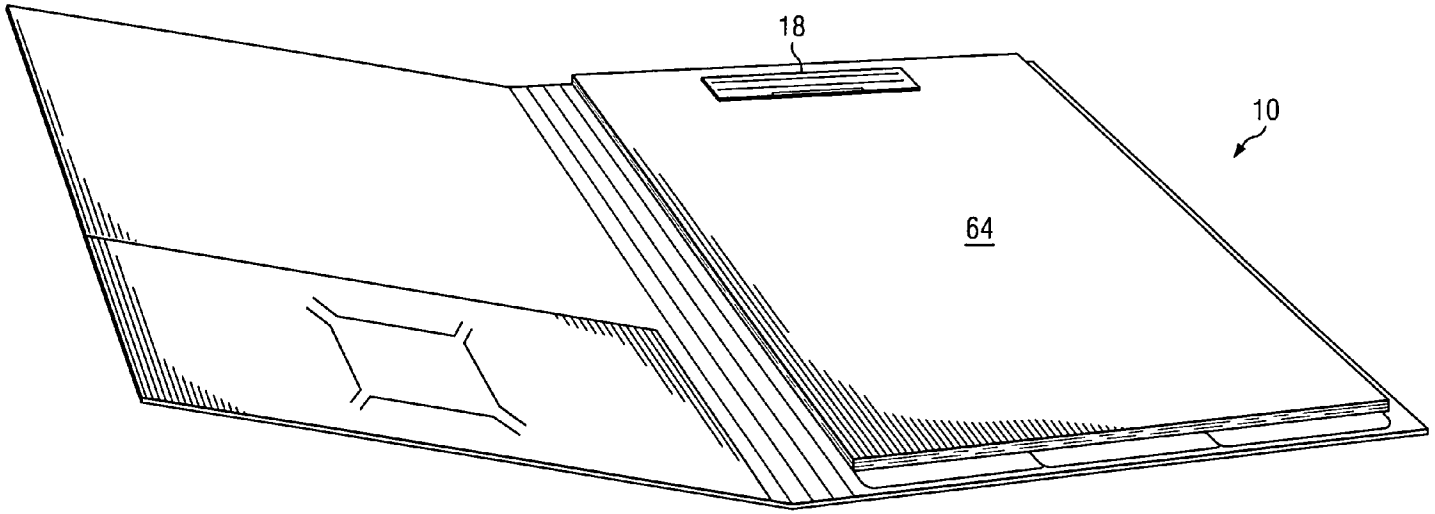
FIG. 7 is a view of the cover of FIG. 1 with the documents held in the cover.
Figure 8:
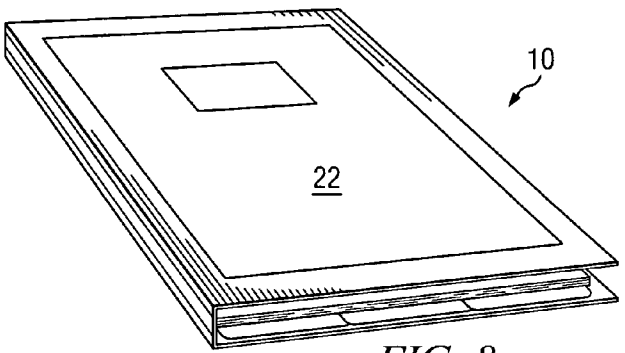
FIG. 8 is a view of the cover of FIG. 1 completed.
Figure 10:
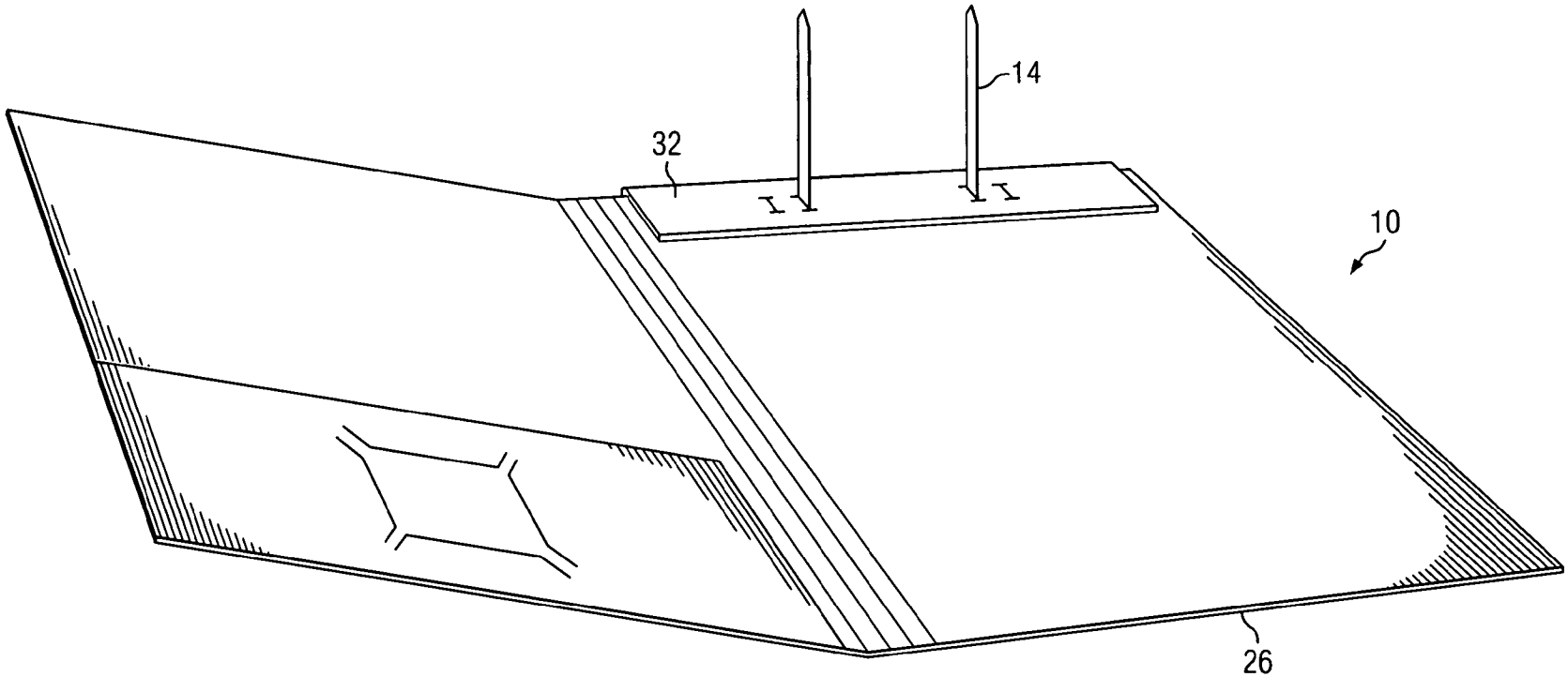
FIG. 10 is a view of the cover of FIG. 1 with the adhesive tape securing the portions to the back cover with built in pocket and prongs ready to receive documents.
Figure 11:
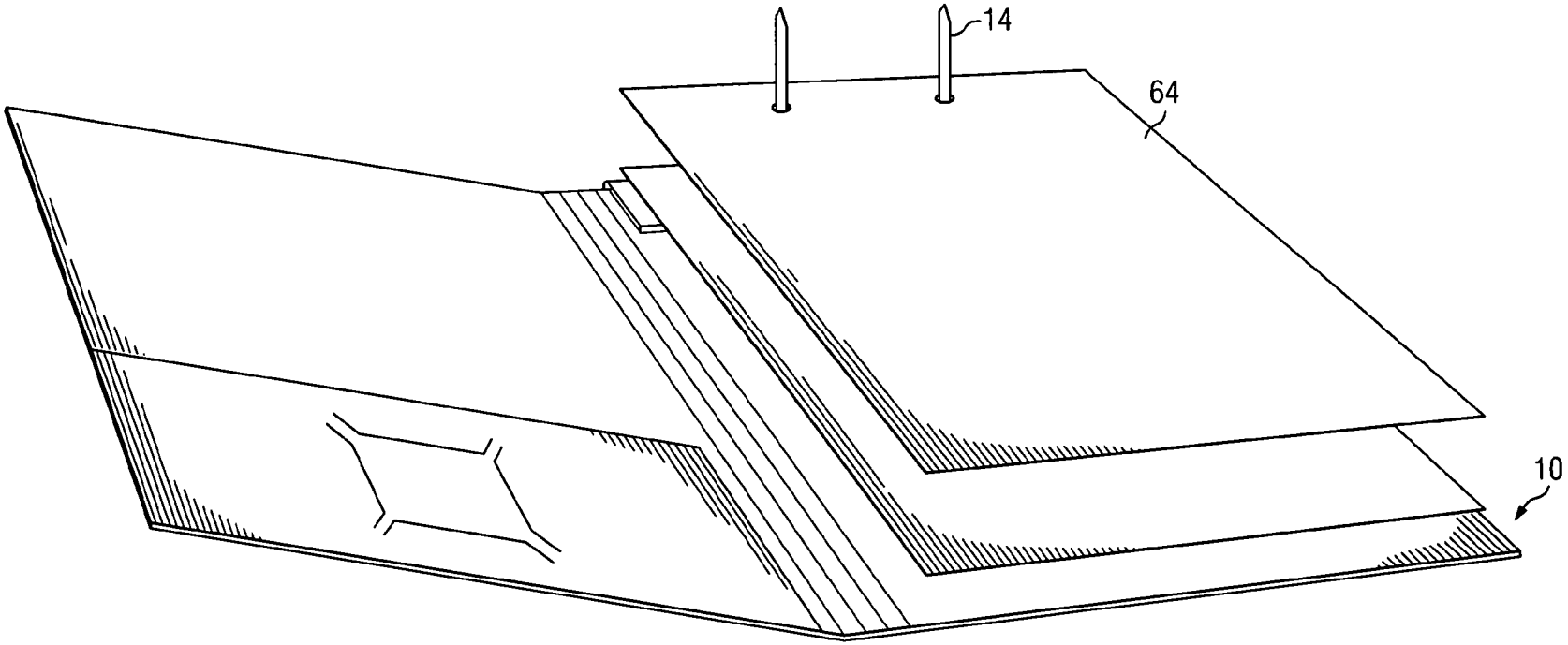
FIG. 11 is a view of the cover of FIG. 1 with an add on version of the first and second portions.
Figure 13:
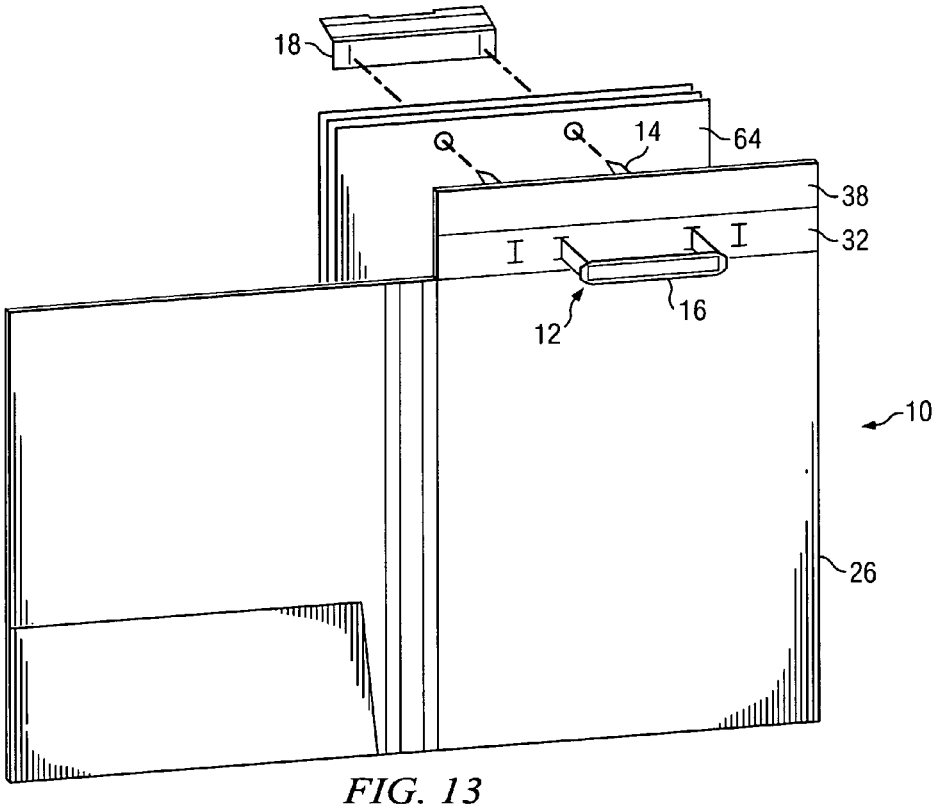
FIG. 13 is an exploded view of the cover of FIG. 1.
Figure 14:
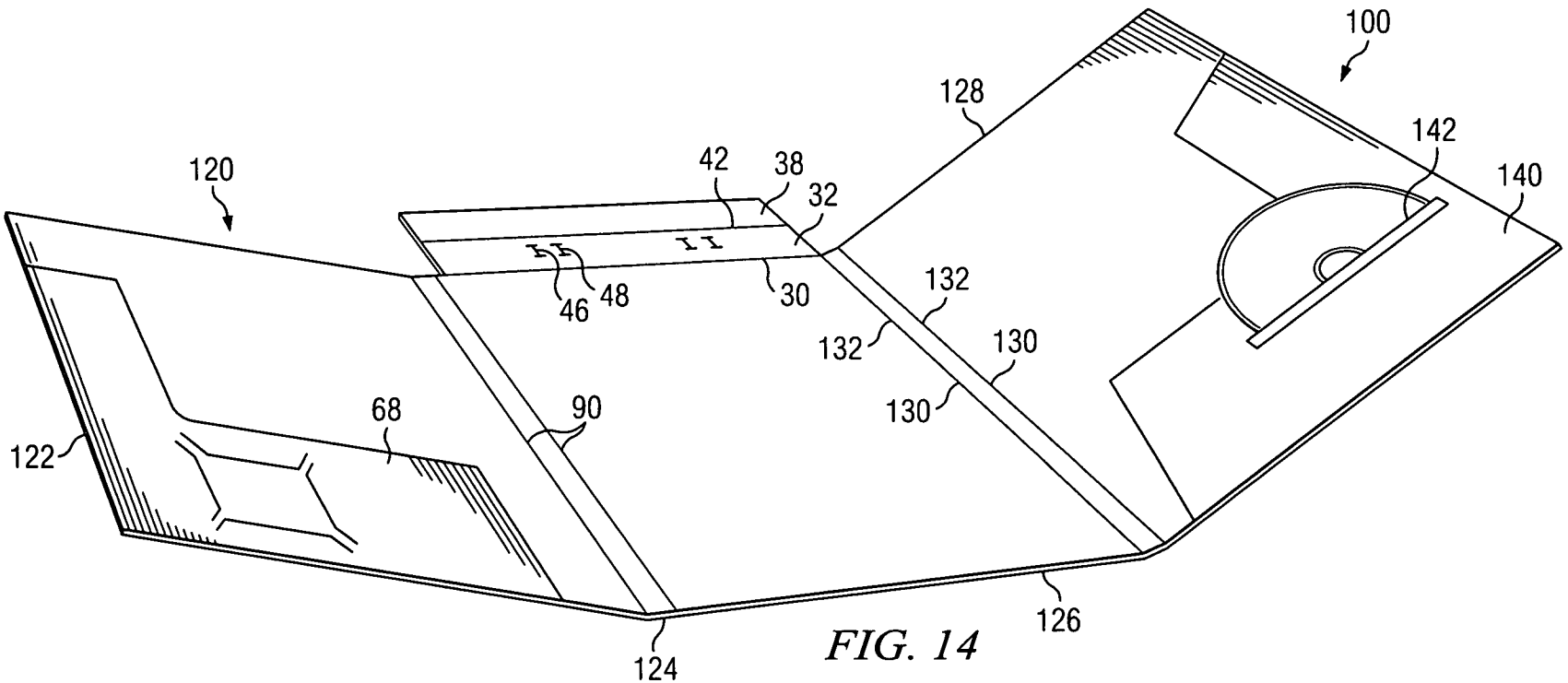
FIG. 14 is a perspective view of a cover forming a modification of the present invention having a third panel.
Figure 15:
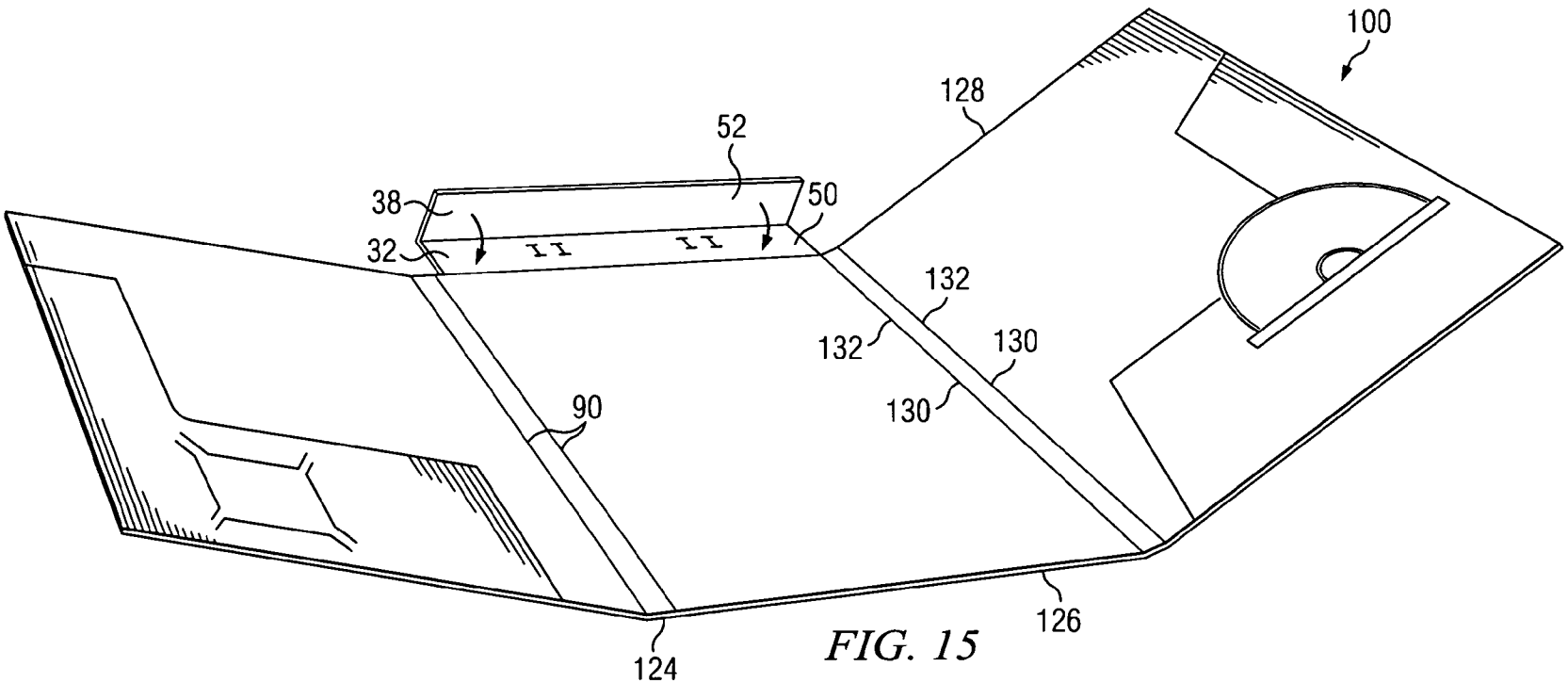
FIG. 15 is a view of the cover of FIG. 14 with the portions being folded.
Figure 16:
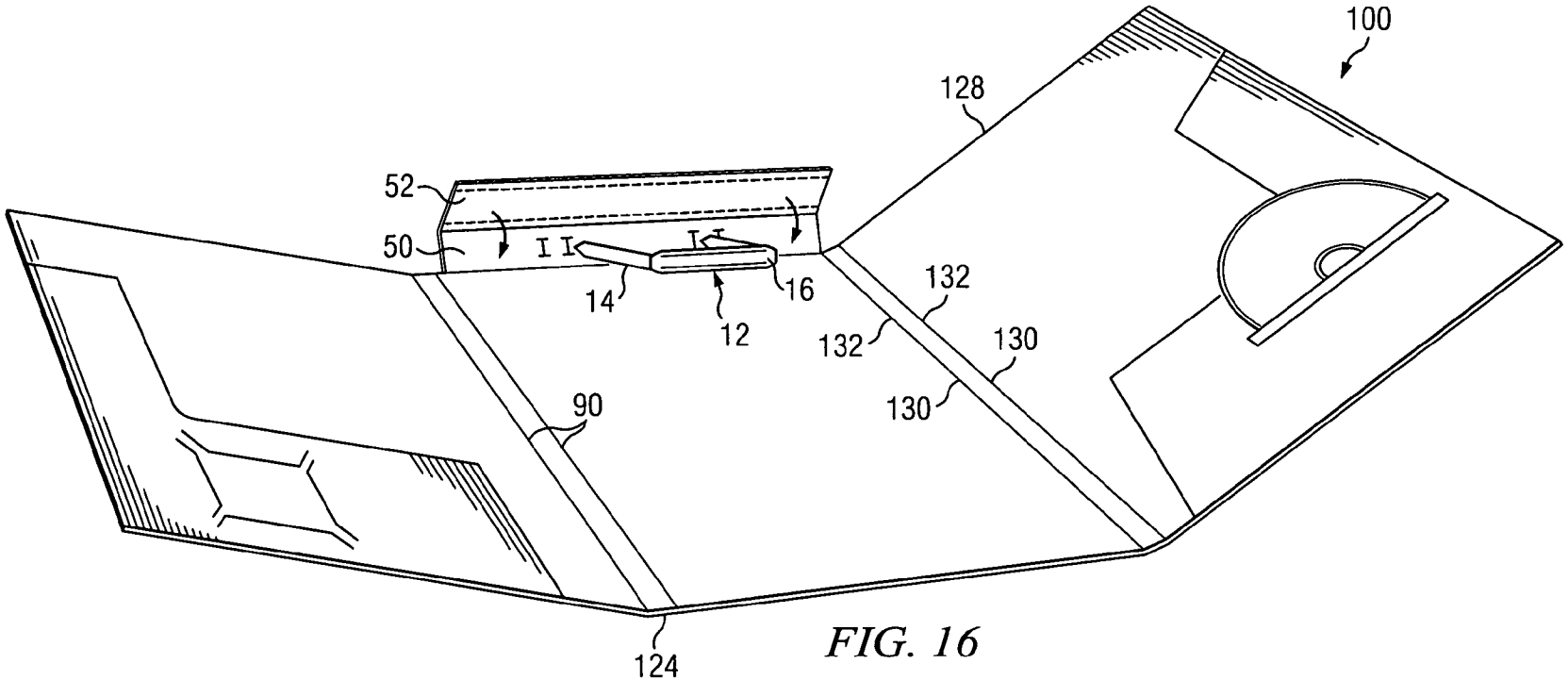
FIG. 16 is a view of the cover of FIG. 14 with the prong fastener about to be inserted.
Figure 17A:
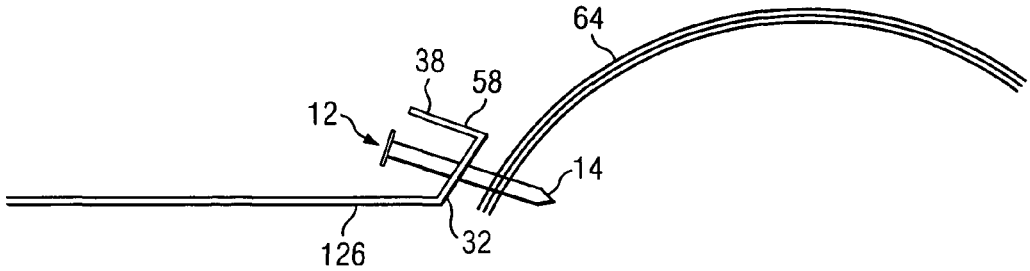
FIGS. 17A and 17B are cross sectional views of the cover of FIG. 14 with the prong fastener inserted.
Figure 17B:
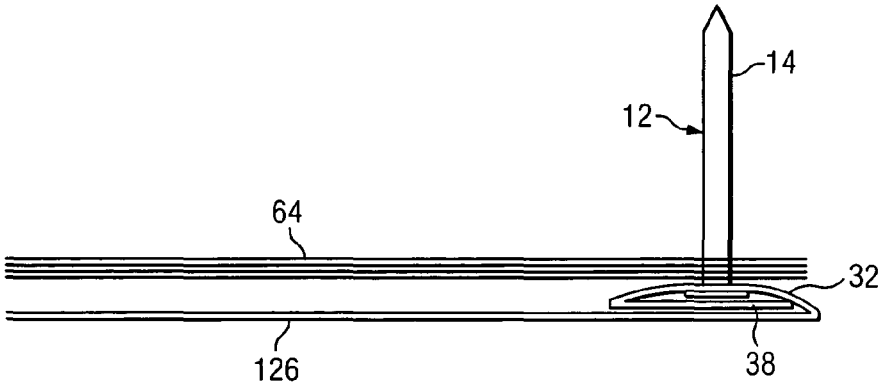
Figure 18:
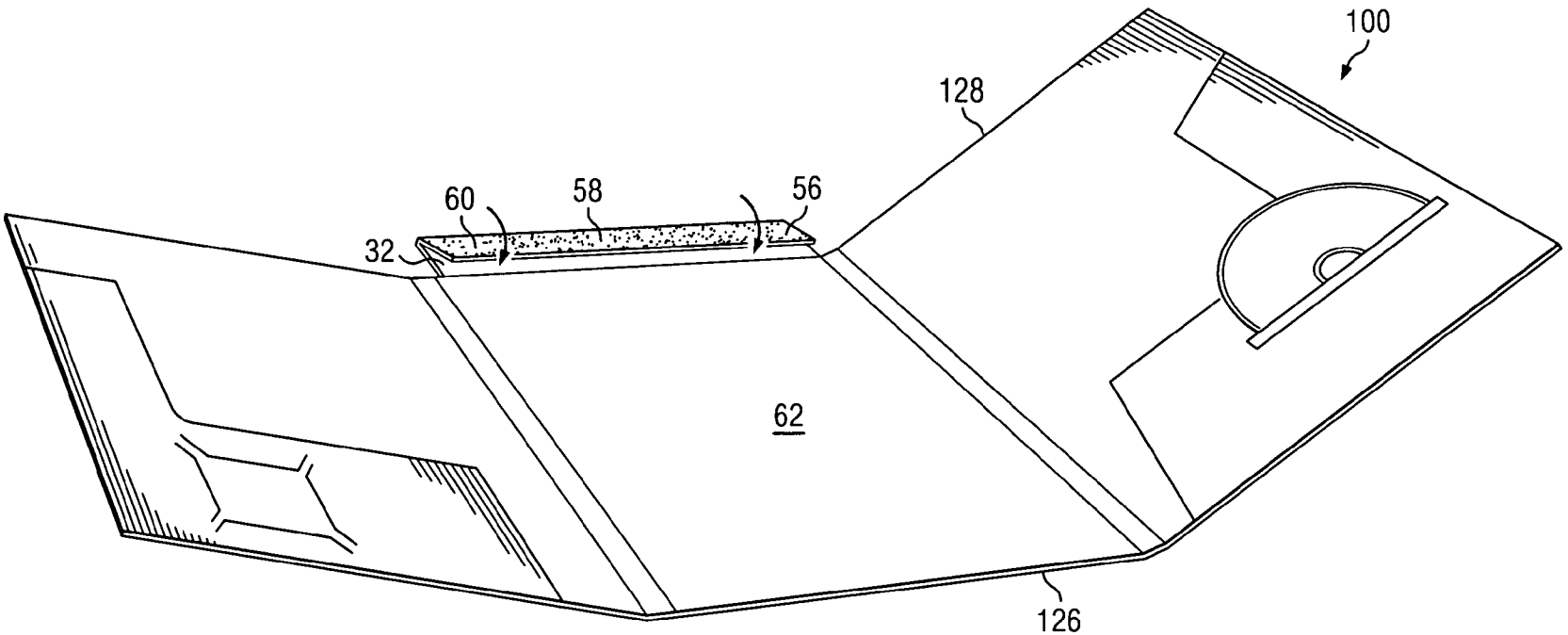
FIG. 18 is a view of the cover of FIG. 14 with the adhesive tape exposed.
Figure 19:
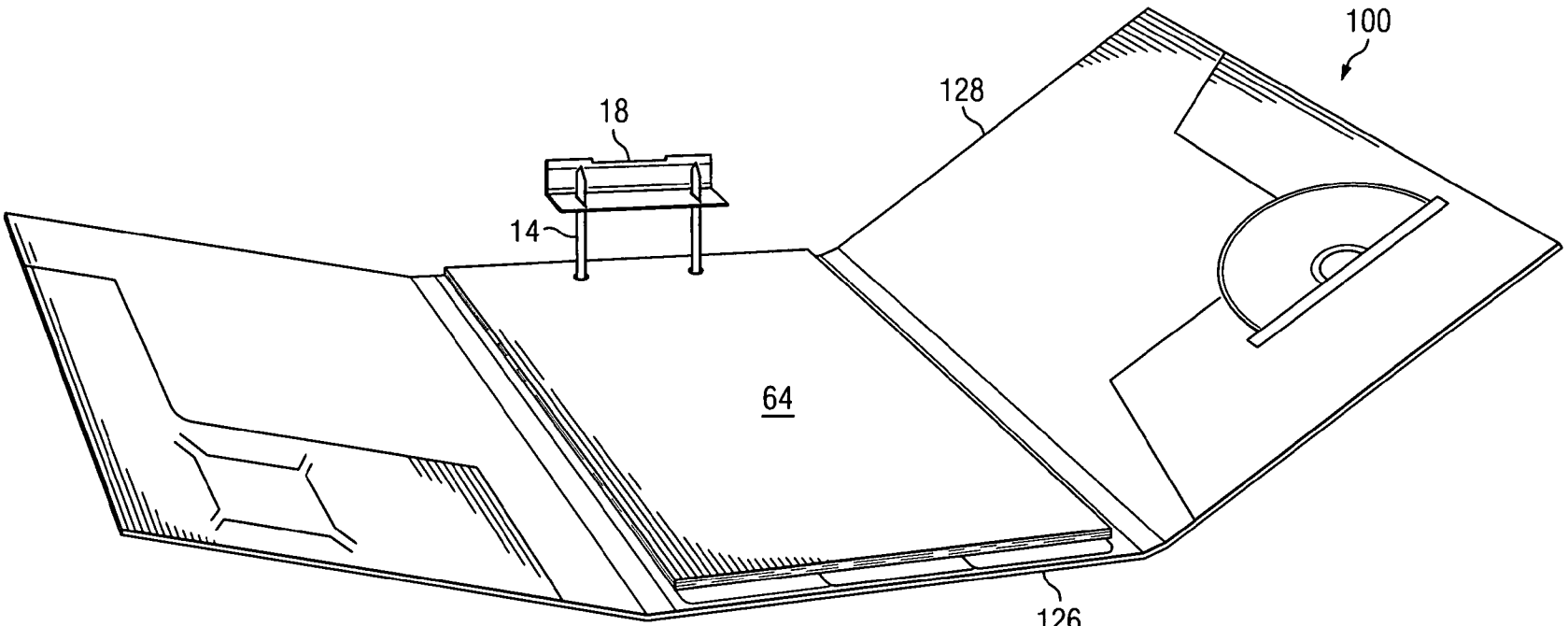
FIG. 19 is a view of the cover of FIG. 14 with documents inserted in the cover and ready to receive the clip.
Figure 20:
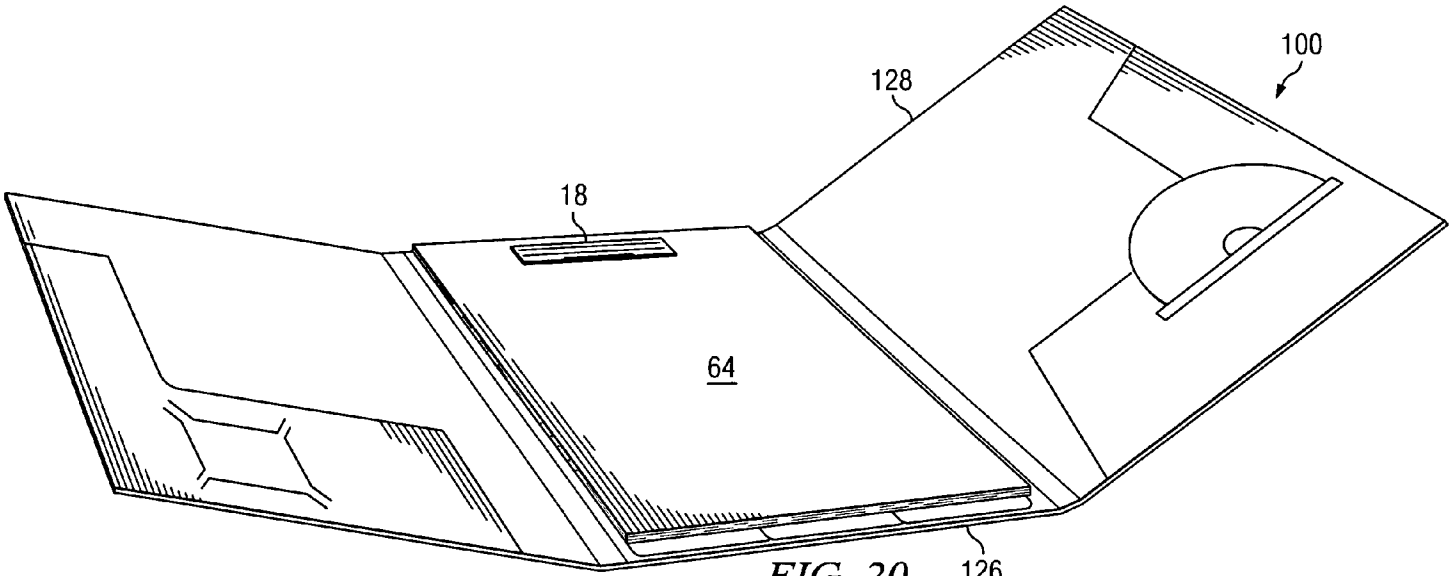
FIG. 20 is a view of a cover of FIG. 14 with the documents held in the cover.

At this point, the first portion 32 is folded about first hinge 36 until the second side 56 of second portion 38 contacts the inner surface 62 of the back cover 26. Just prior to this folding, the sheet 60 is removed from tape 58 so that when the second side 56 contacts the inner surface 62, the tape 58 adheres permanently to the inner surface 62 as seen in FIG. 4B. This results in the prongs 14 extending perpendicular the inner surface 62, ready to receive documents 64 or other materials to be bound in the cover as seen in FIGS. 4B and 10. A clip 18 can be secured to the prongs 14 in the well known manner as shown in FIGS. 6 and 7. However, as well understood, clip 18 need not be used. FIG. 7 illustrates the documents 64 secured in the cover 10 and FIG. 8 illustrates the cover 10 closed, ready for filing or storage. If desired, the cover 10 can actually be assembled with the documents 64 as seen in FIG. 13 by placing the documents 64 over the prongs even before the first and second portions 32 and 38 are folded about hinges 36 and 44.

The adhesive tape 58 is preferably a double sided adhesive tape system which is a permeable non-woven pulp based tissue coated both sides with a specially developed pressure sensitive adhesive. The presence of the tissue within the adhesive lends extra cohesion together with conformability to the tape, rendering the adhesive bond performance superior to what may be expected from a simple unsupported transfer tape. The pressure sensitive adhesive can be a rubber based adhesive. The adhesive tape 58 can have a thickness of about 150 micron while the protective sheet 60 has a thickness of about 55 micron. The adhesive tape 58 can have a layer of adhesive of about 70 gsm, a tissue layer of about 12 gsm and another layer of adhesive of about 70 gsm. Preferably, the adhesive properties of tape 58 would have adhesion to steel of 1600 N/M for both 20 min and 24 hour under the test method BS7116:1990-D, shear adhesion of 100 hours under the test method BS7116:1990-B, and release of the sheet 60 from tape 58 of 15 N/M for 20 min under the test method BS7116:1990-E. A suitable product to form tape 58 is product 2491F sold by SteraTape Ltd., Lancaster Road, Carnaby Ind. Est., Bridlington, YO15 3QY, England.

The embodiment described above and shown in the figures has numerous advantages. The design of the cover 10 allows the user to easily take out the documents 64 or other materials, make copies, and then easily rebind the documents for future reference. All that is necessary is to unbend the prongs 14, remove the documents 64 for what ever purpose needed, place the documents back over the prongs 14 and bend the prongs back. Many bound documents can't be removed or reassembled from a cover without use of special equipment, a typical example being a GBC binder that needs a special machine to open the binder to insert the documents. By use of the adhesive tape 58, the documents 64 and first and second portions 32 and 38 will not sag within the cover 10, but will remain fixed in place as can clearly be seen in FIG. 4B. In addition, adhesive tape 58 will resist the natural inclination of the portions 32 and 38 not to stay folded at 180 degree angles, which would pull the documents up away from the inner surface 62 of the back cover 26. Further, the base 16 is encapsulated between the first and second portions 32 and 38 as noted, eliminating the risk of scratching a recipients desk, or the like. This is a common problem with folders having exposed fasteners, such as many medical folders.

The tape 58 is particularly important to the function of the cover 10. As illustrated, the tape 58 preferably covers substantially all the area, or at least the majority of, the second side 56 of the second portion 38 to provide maximum adhesion of the portion 38 to the back cover 26. This prevents bowing out of the portions from the back cover when documents are held by the cover. Also, it prevents sagging of the portions and any tendency of the prongs 14 to egg out the holes in the documents as they are held in the report. If the documents are not rigidly held in the cover, the documents could rock back and forth like a pendulum within the cover, again causing the prongs 14 to egg out or enlarge the holes in the documents. Of course, adhesive tape 58 can be placed on the inner surface 62 of the back cover 26, rather than on second portion 38, if desired. In such a design, the protective sheet 60 would simply be removed and the first and second portions 32 and 38 folded as before, with the second portion 38 folded onto the adhesive tape 58 to secure the second portion 38 to the back cover 26.

By use of the multiple scorelines 90, documents of varied thicknesses can be held in a single cover 10, reducing the need for a large inventory of covers to fit different size documents. For example, cover 10 can hold from 1 to at least 250 pages.

While the above description and figures show the documents 64 being involved as the cover 10 is assembled, a more likely scenario would be that the cover 10 is assembled first, or preassembled, and then the final assembly of the cover with the documents 64 would take place at a later time. Often these two steps would happen consecutively, but they don't have to. The preassembled covers could be stored for future use. This is a benefit to some businesses since it allows for greater throughput when trying to assemble many documents in a short period of time. For example, for tax returns being bound in covers 10 in April, staff could preassemble the covers ahead of time, leaving only the final assembly of the document to the preassembled cover during the tax rush. This can be a big benefit when the documents are coming off the printer faster than they can be bound in covers, especially when up against hard deadlines like April 15$^{th}$.

Figure 9:
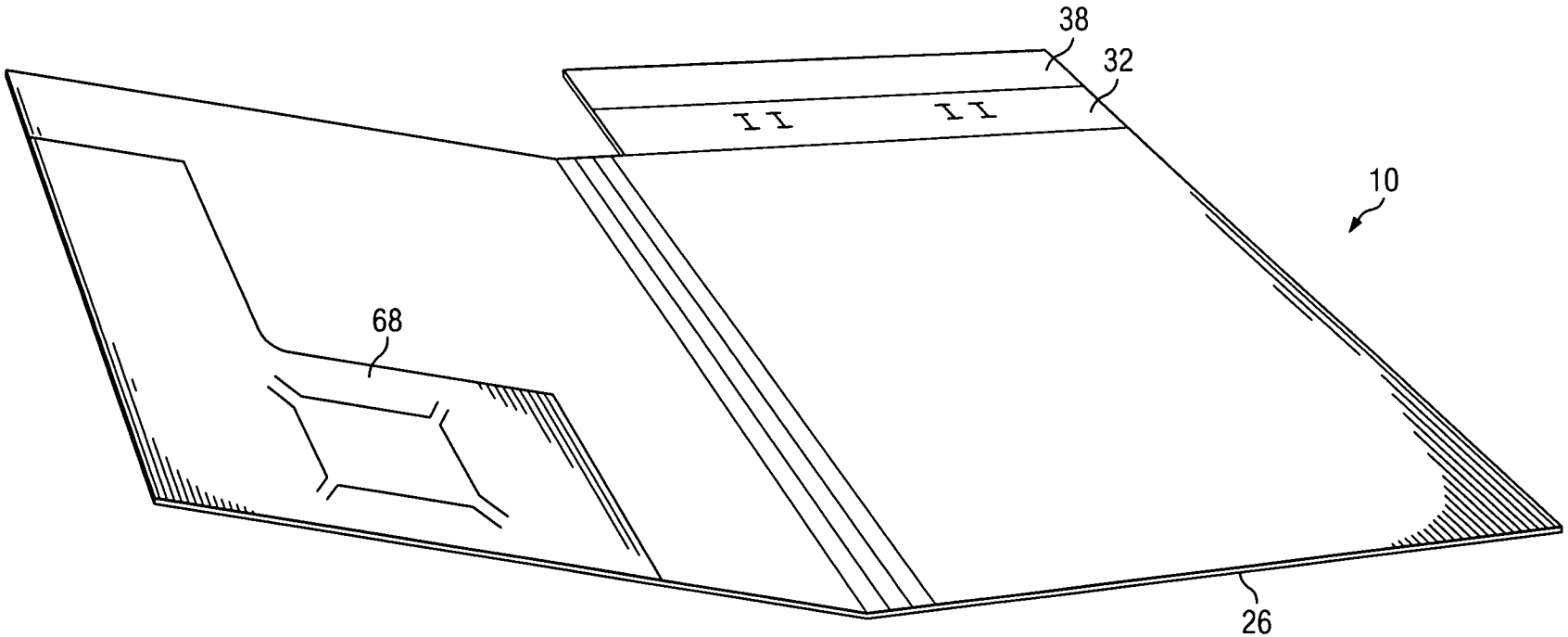
FIG. 9 is a view of a modification of the cover of FIG. 1 using an add on pocket.

As can be seen in FIGS. 1-8, the cover 10 can have a built in pocket 66 forming an integral part of the front cover 22. However, as seen in FIG. 9, the cover 10 can use an optional add on pocket 68 instead. Both pockets 66 and 68 have business card slits. As noted, the spine 24 can have multiple scorelines 90, such as the four scorelines as seen in FIGS. 1-10, to allow the cover 10 to accommodate a wide range of document thicknesses. However, if desired, the spine 24 can have only the scorelines necessary to form the hinge between the front and back covers 22 and 26.

Preferably, one letter size design of the cover 10 will have a height of about 12 inches. This will allow the cover 10 to hold conventional 8½ by 11 inch documents entirely within the cover, but still allow the cover to fit in cabinets and file drawers designed for letter size documents. The secure attachment of the portions 32 and 38 to the back cover will prevent any sagging of the documents in the cover 10 that might otherwise allow a portion of the documents to extend below the lower edge of the cover 10.

In one cover constructed in accordance with the teachings of the present invention designed for use with 8½ by 11 documents, the first portion 32 had a width of 8½ inches and a height, measured between score lines 34 and 42, of 1.25 inches. The second portion 38 had a width of 8½ inches and a height, measured between score line 42 and the top of portion 38, of 1.125 inches. The dimensions of adhesive tape 58 were about 8 inches by 13/16 inches, for an area of about 6.5 square inches, thus covering the majority of the area of the second side 56 of second portion 38. The dimensions of the protective sheet 60 were about 8 inches by 1 inch, creating a finger edge on both sides of the adhesive tape 58 making it easier for the user to peal the sheet 60 off the tape 58 since they can get a fingernail underneath.

Figure 12A:
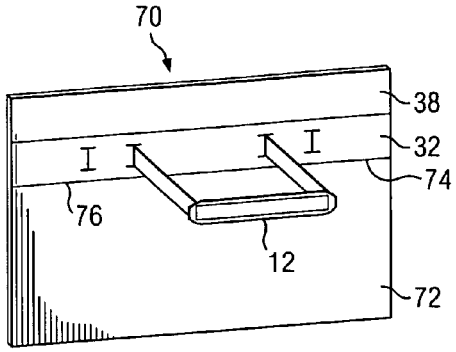
FIGS. 12A and 12B illustrate the modification of the first and second portion used in the cover of FIG. 11.
Figure 12B:
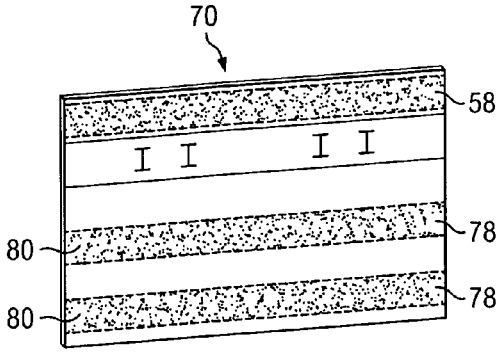

FIGS. 12A and 12B illustrate a modification to cover 10 which includes an add on fastener assembly 70. First and second portions 32 and 38 form part of the assembly 70, but the first portion 32 extends from a third portion 72 instead of being an integral part of back cover 26. First portion 32 is connected by a score line 74 that forms a third hinge 76 between the third portion 72 and first portion 32. Third portion 72 has adhesive tapes 78 thereon permitting the fastener assembly 70 to be secured to the inner surface 62 of the back cover 26 so that the third hinge is positioned in the same place as the first hinge 36 would be if the first and second portions were integral with the back cover 26. Adhesive tapes 78 would use protective sheets 80 until the assembly 70 is to be secured to the back cover 26. A significant advantage of this design is that conventional folders need only have a fastener assembly 70 secured thereto to realize the advantages of cover 10. Thus, a customer need only purchase a supply of the fastener assemblies 70 for use with their existing stock of conventional folders. Adhesive tapes 78 can be formed of the same materials as adhesive tape 58 and protective sheets 80 can be formed of the same materials as protective sheet 60. It will be noted that second portion 38 and adhesive tape 58 actually adhere to the third portion 72, rather than directly to the back cover 26. Adhesive tape 58 can be mounted on the second portion 38, or on the third portion 72, as desired.

Figure 21:
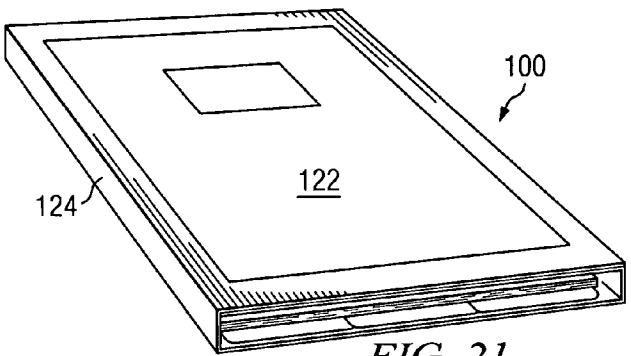
FIG. 21 is a view of the cover of FIG. 14 completed.
Figure 22:
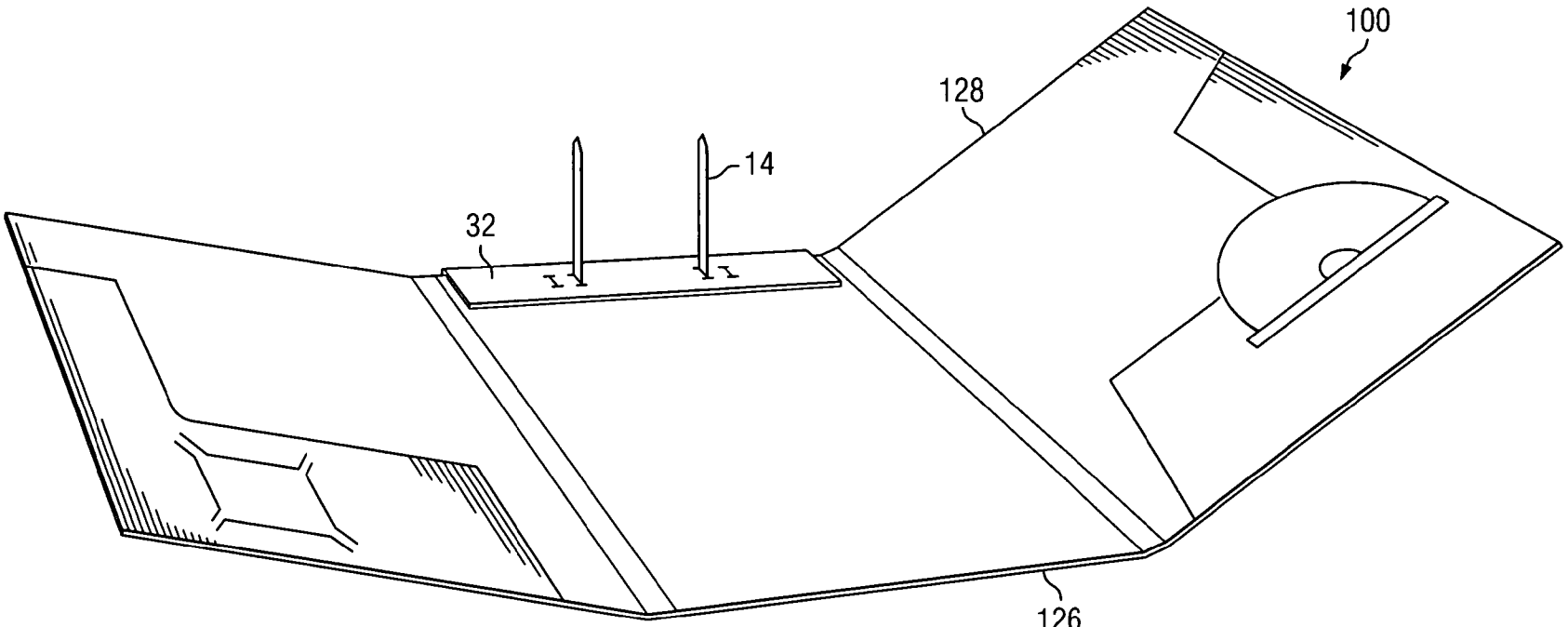
FIG. 22 is a view of the cover of FIG. 14 with the adhesive tape securing the portions to the back cover and prongs ready to receive documents.
Figure 23:
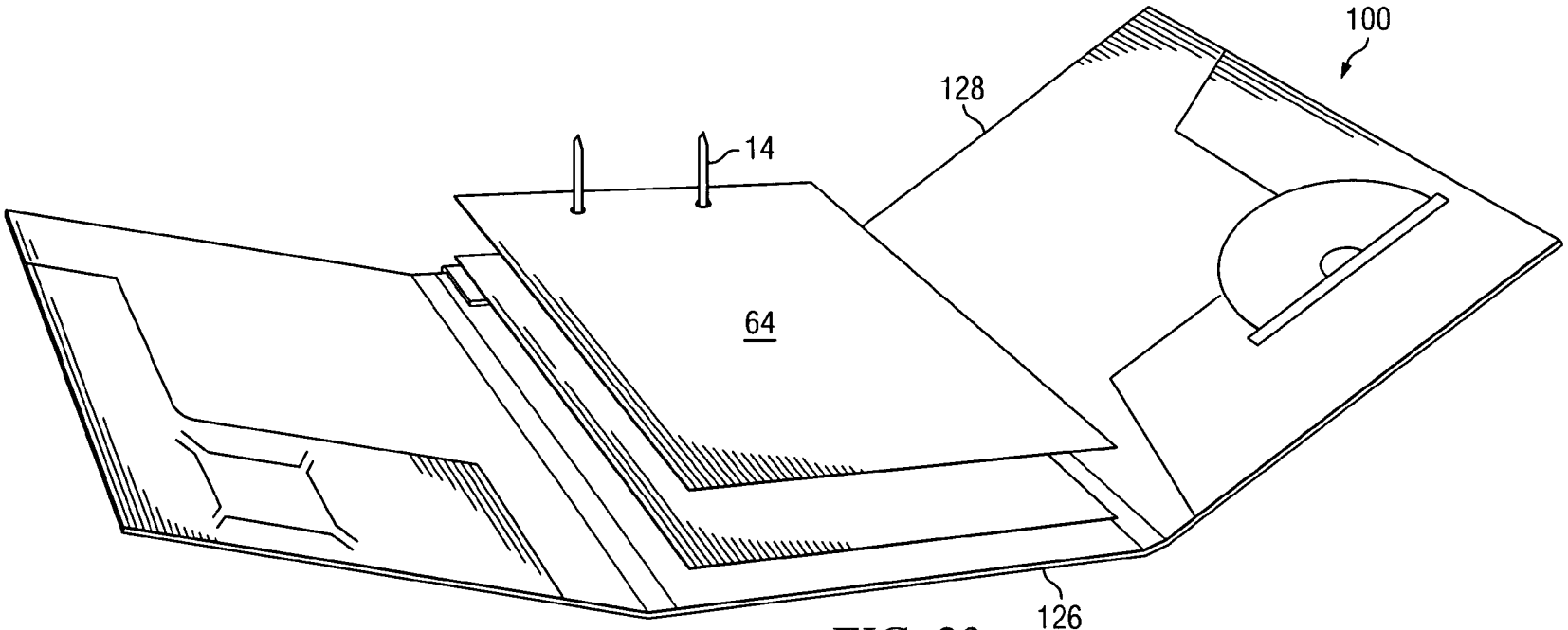
FIG. 23 is a view of the cover of FIG. 14 adding documents.
Figure 24:
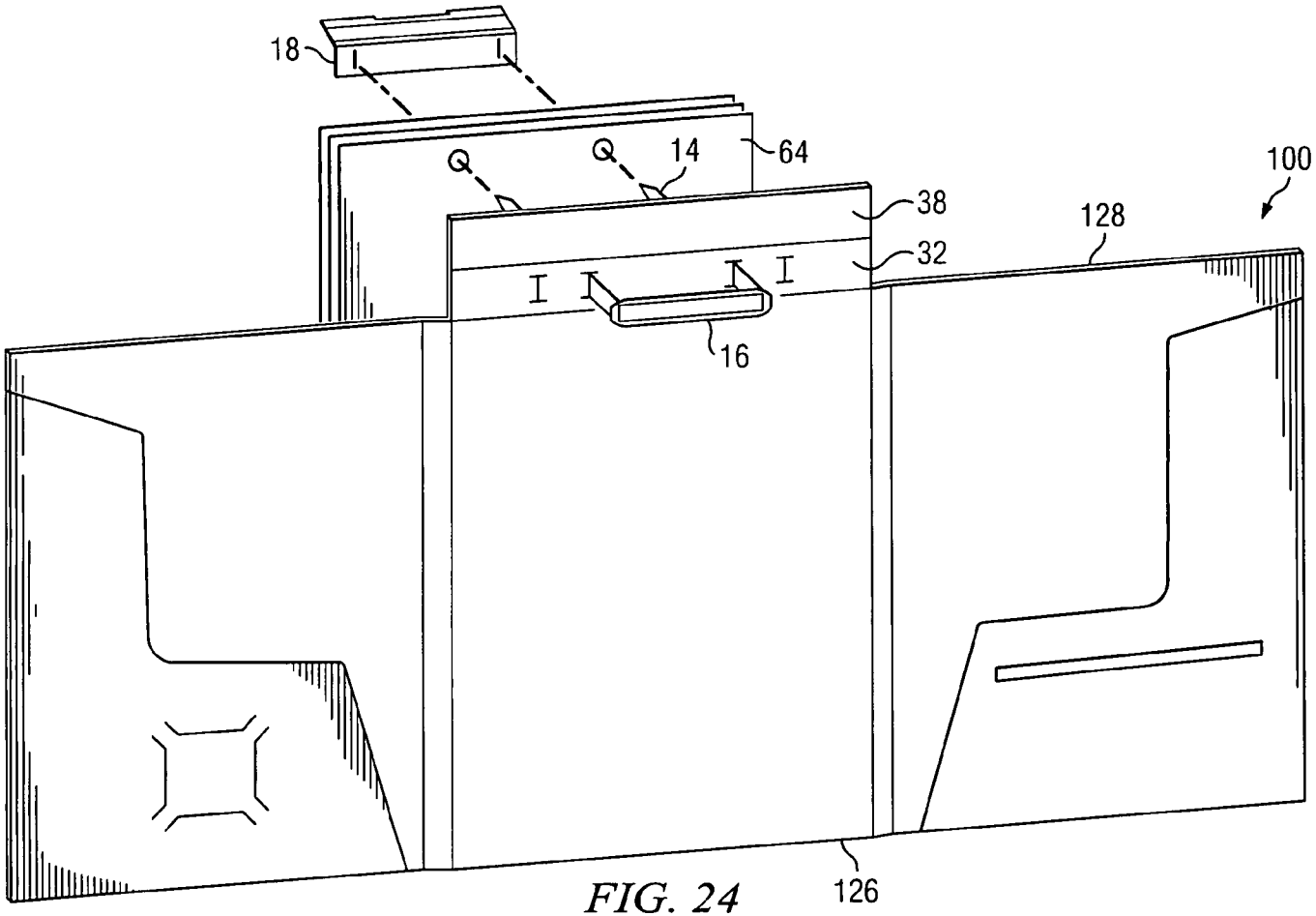
FIG. 24 is an exploded view of the cover of FIG. 14.

With reference now to FIGS. 14-24, a cover 100 forming a modification of the present invention can be seen to include a member 120 forming the front cover 122, spine 124 formed between two score lines 90, back cover 126 and flap 128 of the cover 100. The member 120 is preferably formed by a single integral sheet of material, such as 130 lb, 160 lb, 210 lb, 240 lb or 260 lb paper. The back cover 126 and flap 128 are connected by two score lines 130 that form two hinges 132 between the back cover 126 and flap 128. Many elements of covers 100 and 10 are identical and are identified in the figures with the same reference numerals. Cover 100 has added the flap 128, which can mount an add-on pocket 140 with a CD slit 142, for example. The operation of the cover 100 is identical to that of cover 10, with the additional feature of flap 128 being folded on top of the documents 64 when the cover 100 is closed, as seen in FIG. 21. Cover 100 can also use an add on fastener assembly 70, rather than having first and second portions 32 and 38 integral with the member 120.

While several embodiments of the present invention have been illustrated in the accompanying drawings and described in the foregoing detailed description, it will be understood that the invention is not limited to the embodiments disclosed, but is capable of numerous rearrangements, modifications and substitutions of parts and elements without departing the scope and spirit of the invention.

The invention claimed is:

1. A cover for use with a prong fastener having a base and prongs, comprising:

a member forming at least a back cover;

a first portion hinged to a top edge of the back cover at a first hinge and a second portion hinged to a top edge of the first portion at a second hinge, the first portion having a height, the second hinge spaced from the first hinge the height of the first portion, the first portion having at least two slits formed there through at a set distance apart, each prong of a prong fastener inserted through one of the slits, the second portion folded over the first portion so that a first side of the second portion contacts a first side of the first portion with the second portion covering the base of the prong fastener to encapsulate the base of the prong fastener and hold the prong fastener in place, the first portion folded over the back cover at the first hinge so that a second side of the second portion contacts an inner surface of the back cover; and an adhesive tape between the second side of the second portion and the inner surface of the back cover permanently securing the second portion to the inner surface of the back cover and permanently encapsulating the base of the prong fastener, the base of the prong fastener being encapsulated between the first and second portions without the use of adhesive between the base of the prong fastener and the first and second portions. the cover having only a single first portion and second portion encapsulating the prong fastener with no other portions hinged to said first and second portions. and the cover mounting only a single prong fastener.

2. The cover of claim 1 wherein the first and second portions are part of a fastener assembly, said fastener assembly including a third portion directly hinged to the bottom of the first portion along a third hinge, and an adhesive tape between the third portion and the back cover securing the fastener assembly to the back cover, the third hinge forming the first hinge, the fastener assembly having only a single first portion. second portion and third portion with no other portions hinged to said first, second and third portions and the cover mounting only a single prong fastener.

3. The cover of claim 1 wherein the cover has a built in pocket.

4. The cover of claim 1 wherein the cover has an add on pocket.

5. The cover of claim 1 wherein the cover has a business card slot.

6. The cover of claim 1 wherein the cover has a CD slot.

7. The cover of claim 1 further having a flap hinged to a side of the back cover.

8. A cover for use with a prong fastener having a base and prongs, comprising:

a member forming at least a back cover having an inner surface and an outer surface;

a first portion directly hinged to a top edge of the back cover at a first hinge and a second portion directly hinged to a top edge of the first portion at a second hinge, the second hinge spaced from the first hinge, the first portion having at least two slits formed there through at a set distance apart, the first hinge and second hinge on opposite sides of the slits in the first portion, each prong of a prong fastener inserted through one of the slits, the second portion folded over the first portion so that a first side of the second portion contacts a first side of the first portion with the second portion covering the base of the prong fastener, the prong fastener being secured to the member thereby, the first portion folded over the back cover at the first hinge so that a second side of the second portion contacts the inner surface of the back cover, no portion of the back cover coming into contact with the prong fastener; and an adhesive tape between the second side of the second portion and the inner surface of the back cover permanently securing the second portion to the inner surface of the back cover with none of the adhesive tape, prong fastener or second portion on the outer surface of the back cover, the base of the prong fastener permanently encapsulated between said first and second portions, the second side of the second portion having an area, the adhesive tape covering at least a majority of the second side preventing sagging, the base of the prong fastener being encapsulated between the first and second portions without the use of adhesive between the base of the prong fastener and the first and second portions, the cover having only a single first portion and second portion encapsulating the prong fastener with no other portions hinged to said first and second portions and the cover mounting only a single prong fastener.

9. The cover of claim 8 wherein the first and second portions are part of a fastener assembly, said fastener assembly including a third portion directly hinged to the bottom of the first portion along a third hinge, and an adhesive tape between the third portion and the back cover to secure the fastener assembly to the back cover, the third hinge forming the first hinge. the fastener assembly having only a single first portion, second portion and third portion with no other portions hinged to said first, second and third portions and the cover mounting only a single prong fastener.

10. The cover of claim 8 wherein the cover has a built in pocket.

11. The cover of claim 8 wherein the cover has an add on pocket.

12. The cover of claim 8 wherein the cover has a business card slot.

13. The cover of claim 8 wherein the cover has a CD slot.

14. The cover of claim 8 further having a flap hinged to a side of the back cover.

15. The cover of claim 1 wherein the first portion and the second portion stay folded at 180 degree angles by the permanent adherence of the second portion to the back cover by the adhesive tape.

16. The cover of claim 8 wherein the first portion and the second portion stay folded at 180 degree angles by the permanent adherence of the second portion to the back cover by the adhesive tape.

17. The cover of claim 1 wherein the slits are 2 ¾ inches apart.

18. The cover of claim 1 wherein the slits are 4 ¼ inches apart.

19. The cover of claim 1 wherein the first portion has two pairs of slits, a first pair of slits 2 ¾ inches apart and a second pair of slits 4 ¼ inches apart.

20. The cover of claim 1 wherein the adhesive tape has a layer of adhesive of about 70 gsm, a tissue layer of about 12 gsm and another layer of adhesive of about 70 gsm, with adhesive properties of adhesion to steel of 1600 N/M for both 20 min and 24 hour under the test method BS7116:1990-D, shear adhesion of 100 hours under the test method BS7116:1990-B, and release of the tape of 15 N/M for 20 min under the test method BS7116:1990-E.

* * * * *